United States Patent [19]

Landry

[11] 4,153,396

[45] May 8, 1979

[54] ROTARY ENGINE OR PUMP

[76] Inventor: Edgar F. Landry, 88 Mildred Ave., Springfield, Mass. 01104

[21] Appl. No.: 853,094

[22] Filed: Nov. 21, 1977

[51] Int. Cl.[2] ..... F01C 1/00; F03C 3/00; F04C 1/00

[52] U.S. Cl. ..... 418/38

[58] Field of Search ..... 418/33, 34, 35, 38; 123/245

[56] References Cited

U.S. PATENT DOCUMENTS

| | | | |
|---|---|---|---|
| 2,734,489 | 2/1956 | Tschudi | 418/38 |
| 3,183,898 | 5/1965 | Sandone | 418/38 |
| 3,505,981 | 4/1970 | Turnbull | 418/38 |
| 3,595,014 | 7/1971 | McMaster | 418/35 X |

FOREIGN PATENT DOCUMENTS

| | | | |
|---|---|---|---|
| 1094785 | 5/1955 | France | 418/35 |
| 947812 | 1/1964 | United Kingdom | 418/38 |

*Primary Examiner*—Carlton R. Croyle
*Assistant Examiner*—Leonard E. Smith
*Attorney, Agent, or Firm*—Ross, Ross & Flavin

[57] ABSTRACT

A control system for a rotary internal combustion engine or pump compressor including a pair of shaft-mounted controllers, the two shafts being co-axial with one being disposed within the other for the in seriatim rotation of the shafts as to each other. Additional to the controllers, two pairs of balls are provided with the shafts, controllers and balls being disposed within an elliptical cam extended through a wall of a housing for the control of the rotation of the shafts wherefor a first one will rotate through an arc of say 60° while the second one will rotate through an arc of say 120° and an alternation takes place so that the first one next moves through an arc of 120° and the second one moves through an arc of 60°.

4 Claims, 5 Drawing Figures

ROTARY ENGINE OR PUMP

This invention relates to improvements in a rotary engine or pump, whether the actuating medium be the product of explosion or combustion or an expansible fluid such as steam, compressed air or other medium.

The invention comprehends a two-section construction: (a) a power section, and (b) a timing and driving section external thereto.

In the past, the relative motion of the pistons has been provided for by gearing or crank arm means but neither system has allowed a harmonic sequence and the pistons tend to come to a stop during each revolution, providing a generally jerking action with high inertial loading.

The power section hereof is that of generally known type in rotary engines or pumps wherein a secondary shaft is co-axial with and disposed within a primary quill-like shaft, wherein the shafts are in seriatim rotated as to each other, wherein each shaft mounts a pair of oppositely-disposed pistons or working members whose center lines are also co-axial, wherein the two pairs of pistons or working members rotate axially in a single direction about the common fixed axis and accelerate and decelerate as to each other within a common single cylinder with each pair defining a pair of working chambers formed in each instance by a surface of a piston and the confronting surface of the next-adjacent piston, wherein the co-axial shafts exit through one end of the cylinder for driving interconnection with the timing and driving section, wherein the working fluid is alternately introduced into and withdrawn from each working chamber to act upon the movable piston and produce the mechanical force output through the other end of the cylinder, wherein the pistons are in seriatim alternately and relatively moved at increased and decreased speeds to expand and contract the respective working chambers, and wherein the rotative movements of the pistons are controlled by the coacting elements of the cooperant timing and driving means.

The heart of the invention is in the timing and driving section and it is directed to the control mechanism for controlling the driving of the coaxial shafts alternately and intermittently. It includes a pair of varying-motion controllers of opposite phase, one driving and one driven, and each being keyed to one of the shafts and designed, conjointly, to provide perfect mass balance.

The controllers have portions of their longitudinal extents extendable through an elliptical cam provided through a vertically-disposed wall and are further provided in association therewith with two pairs of balls, the balls being held captive between the controllers and the cam and follow the cam upon the rotation of the driving controller to the end of intermittently and alternately moving the driven controller and hence controlling the rotative movements of both shafts secured thereto.

Each controller, of generally U-shaped configuration, defines a circular vertically-extending collar from one face of which project a pair of diametrically-opposed longitudinally-extending guides, with the outer peripheral surface of each guide being in coincidence with the collar periphery, and with each of a pair of opposite working faces of each guide extending radially inwardly from a respective edge of the respective outer peripheral surface toward but spaced from the controller longitudinal center line so as to define a generally Vee-shaped block of segmental cross-section. With the guides of the driving controller located at 12 o'clock and 6 o'clock positions respectively and facing the guides of the driven controller located at 3 o'clock and 9 o'clock positions respectively, the two controllers may be disposed in interdigitated relation as to each other when in face-to-face juxtaposition.

Each guide is provided at, and intermediate of, each of its sides with a half recess of arcuate configuration extending inwardly from its outermost arcuate surface through to the respective radially-disposed working face thereof.

With the controllers internested, a half recess at one side of one guide of one controller moves toward and away from a confronting half recess of the next-adjacent guide of the other controller to define in each instance a full recess, with the half recesses functioning as an elevator as the respective controllers move toward or away from each other.

In each full recess, a ball is disposed, same being held captive by means of the elliptical cam provided in the wall.

Operationally, the driving controller is moved by means of the explosive force which imparts a rotative movement to that controller in a given forward or advancing direction through an arc of predetermined degree wherefore it imparts to the driven controller a rotation through an arc of smaller degree in the same forward or advancing direction.

In this invention, the live actuating medium may be inducted through a port or ports and the spent actuating medium may be discharged or scavenged through a port or ports, as two sets of pairs of pistons employed within a common cylinder offer a piston phasing means which allows the pistons to continuously rotate as they phase and does so in a harmonic sequence which keeps the inertial loads to a minimum while utilizing a simple, yet rugged, structure for the phasing means.

Further objects of the invention are to provide an apparatus which is inherently axially balanced and relatively vibration-free, has increased power and torque output for its cubic displacement, and is of simple and easily manufactured design.

These objects are accompanied by the further advantageous objects of simplicity and inexpensiveness of construction and capability of long continued performance without the requirement of repair or other attention.

Further and incidental objects comprise the provision of an improved engine or pump which will be compact in form, and economical in performance, the entire motor being generally superior in efficiency, reliability, durability and serviceability.

With the above and other objects in view, the invention consists in the novel and useful provision, formation, combination, association, coaction, inter-relation and relative arrangement of parts, members and features, all as hereinafter described, shown in the drawings, and finally pointed out in the claims annexed hereto.

Figure 1:
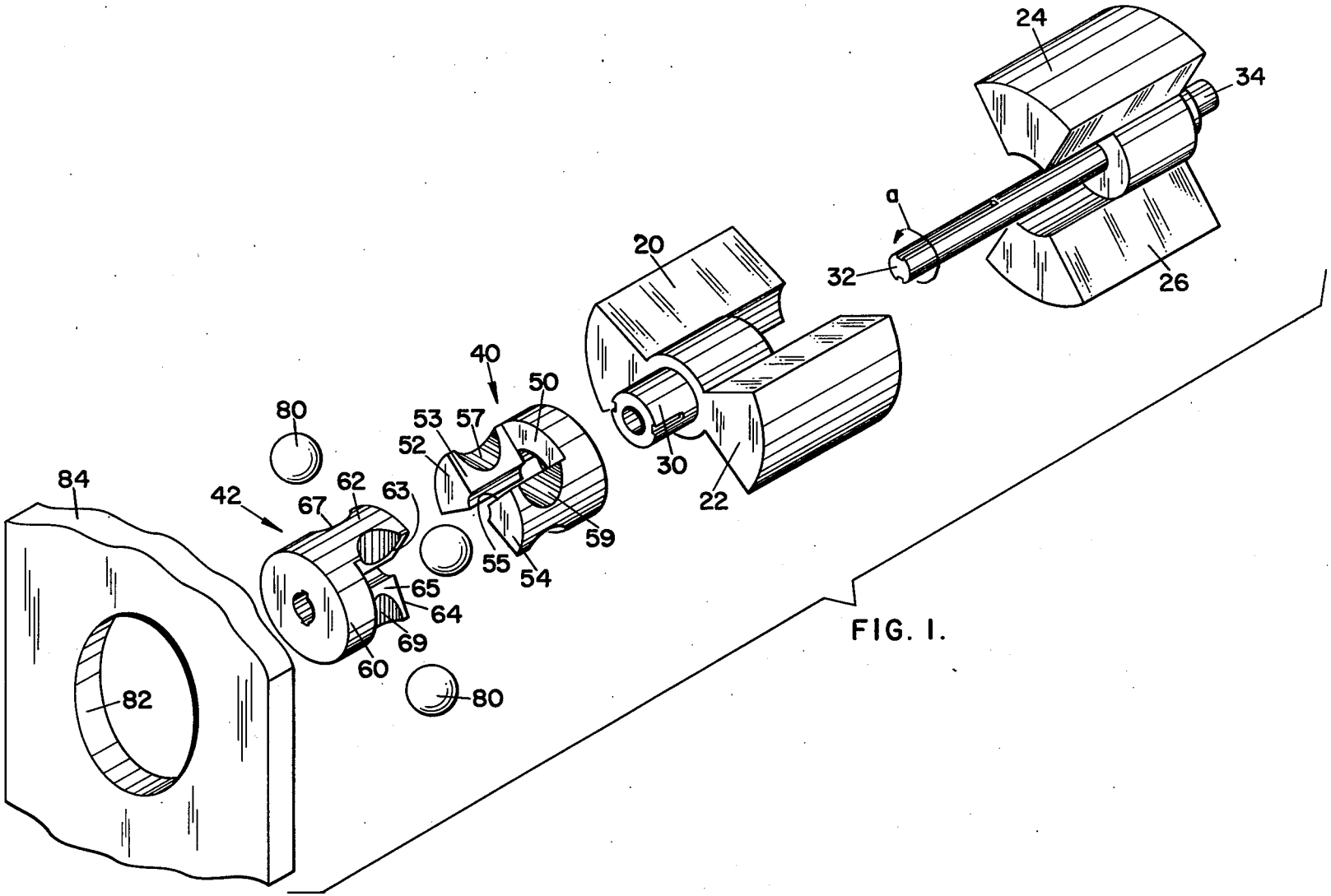
FIG. 1 is an exploded isometric view showing the relationship of the components of the power section at the right hand side of the view and of the timing and driving section at the left hand side of the view.
Figure 2:
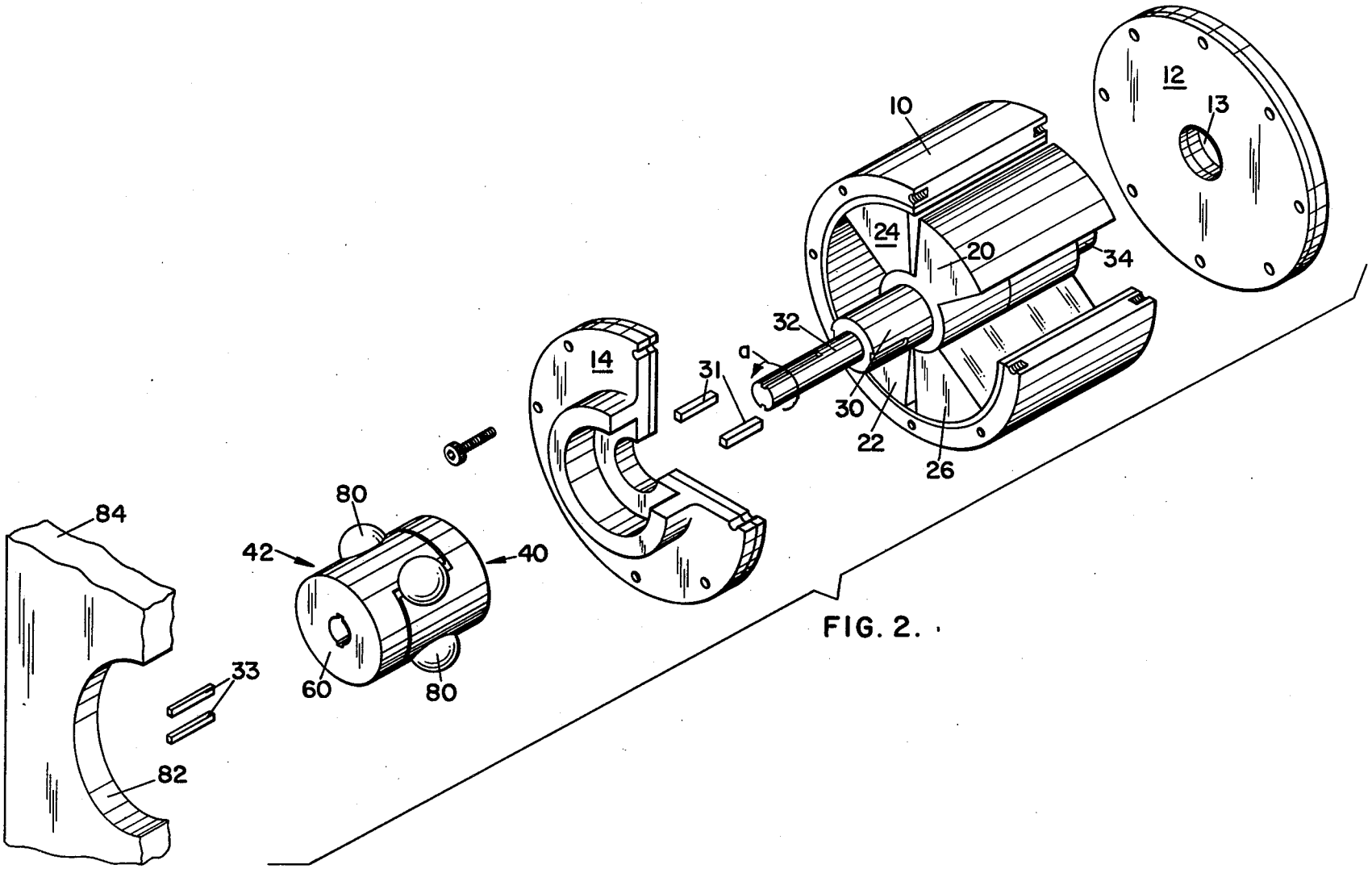
FIG. 2 is an exploded isometric view showing the FIG. 1 components of the power and timing and driving sections in closed operating relationship with each other and showing the housing or cylinder and heads thereof.
Figure 5:
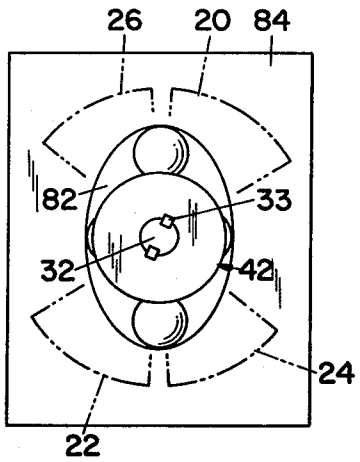
FIGS. 3, 4 and 5 are schematic views of the components of the timing and driving section in three operating positions thereof.
Figure 4:
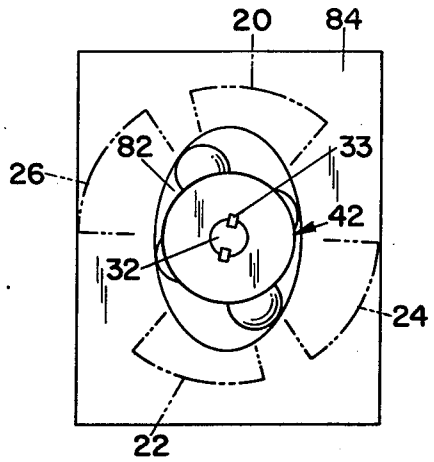
Figure 3:
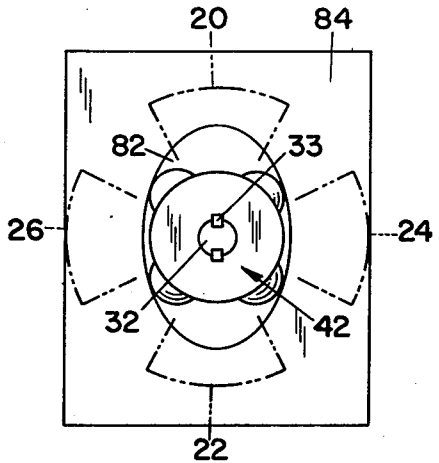

Referring with particularity to the drawings, 10 designates the cylinder of a motor or pump, 12 designates its outboard head, and 14 designates its inboard head, the components being interlocked in known manner. 20 and 22 designate pistons in a primary couple or pair and 24 and 26 designate pistons in a secondary couple or pair the pistons of the pairs being understood to rotate in the cylinder in a common direction at all times as indicated by arrow a in FIGS. 1 and 2.

Primary pistons 20 and 22 are mounted on a quill shaft 30 and secondary pistons 24 and 26 are mounted on a shaft 32 rotative within and relative to the quill shaft, shaft 32 having an outboard end 34 which extends through and is journalled in a suitable central opening 13 in outboard head 12 for the usual take-off purposes.

The pistons sweep the inner surface of the cylinder 10 and may be provided with suitable piston "rings" (not shown) extending across the sweep faces of the pistons in directions parallel to the axis of the coaxial shafte 30, 32.

Means are provided for causing pistons 20, 22 of the primary pair and 24, 26 of the secondary pair to execute the particular and peculiar movements hereinafter to be recited, whereby pressure and actuating media are utilized to in turn actuate the pistons. In the particular embodiment shown, it is to be understood that, as is common, a compressed charge of combustible mixture such as vaporized gasoline or petrol mixed with air is to be used for actuating the pistons, such compressed charge, or successive charges, being fired in what may be designated as the compression and firing chamber. Such actuating medium is drawn in through a large inlet or induction port which is not shown but will be understood to be located at one position in the cylinder and as spaced but slightly from a large outlet or exhaust port also not shown, this latter port being larger than the inlet port or extending over a greater segment of the circle of the cylinder, so that the greatest possible exhaust period may be provided in the movement of each piston during the exhaust period, and through what is designated as an exhaust chamber. An induction chamber, into which fresh actuating medium is inducted or drawn by the movement of each successive piston after it has swept over and opened the inlet port and an expansion chamber through which each successive piston moves as the actuating medium is expanding or exerting its strength upon such piston are also defined by the rotating pistons in known manner.

The timing and driving means causes each piston to execute two accelerations and two retardations in each complete rotation within the cylinder. Thus, primary pistons 20 and 22, being coupled together, always accelerate at the same times and always retard at the same times and periods, and the same is true of secondary pistons 24 and 26. The timing and driving means also cause piston 22 to twice diminish the distance between it and piston 26 and twice to increase such distance, during each continuous rotation of such pistons 22 and 26 in each complete rotation of such pair of pistons. The same is true with respect to pistons 26 and 20 next ahead of it, with respect to pistons 20 and 24 next ahead of it, and with respect to pistons 24 and 22 next ahead of it. This is accomplished by the alternate acceleration and retardation of each such piston, due to the action of the timing and driving means to such accelerations and to such retardations occurring in each complete rotation of each piston. These joint and combined actions of each pair of pistons, namely, one pair mounted upon quill shaft 30 and one pair mounted upon shaft 32 are utilized to produce a complete induction of the actuating medium into the induction chamber 11, a complete compression of such actuating medium in the compression and firing chamber, a complete expansion of such actuating medium in the expansion chamber, and a complete exhaust or evacuation of the spent actuating medium in the exhaust chamber.

I thus obtain in the complete rotation of each piston a four-cycle action, the operative effect of which is the same as the four-cycle piston action obtained in each pair of complete excursions of the piston in a four-cycle motor of the reciprocating piston type.

And I accomplish this without the use of valves for the ports, and without the objectionable reversal of movement of the piston which occurs in such reciprocating types of motors.

It will be understood that primary pistons 20 and 22 overlap secondary pistons 24 and 26, each such piston being substantially L-shaped as best shown in FIG. 1, and thus accomodating the mounting of pistons 20 and 22 at the portion of quill shaft 30 extending at one end of cylinder 10 and the mounting of pistons 24 and 26 at the end of shaft 32 and outward of the cylinder with respect to the portion of quill shaft 30 which carries pistons 20 and 22. This is accomplished by reversing the L-shapes of pistons 24 and 26 with respect to the L-shapes of pistons 20 and 22.

Treating more specifically of the timing and driving section, same will be seen to comprise a primary controller generally designated 40 which is mounted on primary quill shaft 30 and a secondary controller generally designated 42 which is mounted on secondary shaft 32.

Each controller is of generally U-shaped configuration.

Controller 40 has a circular vertically extending collar 50 from the inboard face of which project a pair of diametrically-opposed longitudinally-extending guides 52,54 having opposite radially disposed working faces 53 and 55 respectively, with each working face being provided with a half recess 57 and 59 respectively of arcuate configuration.

The outer peripheral surface of each guide is in coincidence with the collar periphery and the opposite radially-extending working faces project inwardly from the respective outer peripheral surface of the guide toward but spaced from the longitudinal center line of the controller to define a generally Vee-shaped block of segmental cross section.

Secondary controller 42 has a circular vertically-extending collar 60 from the outboard face of which project a pair of diametrically-opposed longitudinally-extending guides 62, 64 having opposite radially disposed working faces 63 and 65 respectively with each working face being provided with a half recess 67 and 69 respectively of arcuate configuration.

With the controllers internested as is made possible when the guides of the primary controller are located at 12 o'clock and 6 o'clock respectively and facing the guides of the secondary controller located at 3 o'clock and 9 o'clock positions respectively, so that the two controllers may be disposed in interdigitated relation as to each other when in face to face juxtaposition.

Primary controller 40 is splined to quill shaft 30 as by keys 31 receivable in suitable keyways.

Secondary controller 42 is spliced to shaft 32 as by keys 33 receivable in suitable keyways.

With the controllers so internested, the half recess of one guide of one controller is moved toward and away from a confronting half recess of the next adjacent guide of the other controller to define in each instance a full recess which functions as an elevator.

Into each full recess, a captive ball 80 is disposed, same being held in situ by means of the elliptical guideway or cam 82 provided in a vertically extending wall 84 spaced inboard of the inboard head of the cylinder.

The driving or outboard controller is rotated by means of the prime mover which imparts a rotative movement of that controller in a given direction so that it is rotated through an arc of predetermined degree in a forwardly or advancing direction so that it imparts to the driven or second controller a rotation through an arc of smaller degree in the same forward or advancing direction.

It thus occurs that the controllers are rotated in step with and by the shaft 5 and quill shaft 6, the rotation of which is of course caused by the actuation of the piston pairs in the cylinder. That rotation produces two accelerations and two retardations of each of pistons as it executes each complete rotation in a constant forward direction, and such acceleration and retardation is in turn imparted to the respective pistons which are rigidly coupled with a respective controller through its respective shaft as the case may be. Thus each piston is given two accelerations and two retardations in each rotation within the cylinder. The controllers while rotated, as stated, by the shaft or quill shaft are thus, it will be seen, given an irregular or differential movement due to the action of the balls riding up and down in the elevators. And this action causes a rotation of the controllers which produces the differential action of the shafts.

Thus it will be seen that the rotation of such controllers gives the regular phasing to the shafts which in retardation and acceleration retard and accelerate correspondingly the pair of primary pistons on the one hand and secondary pistons on the other hand. It will be understood that the power generated by the motor is taken from the secondary shaft.

From the foregoing description taken with the drawings, it will be easy to trace the action of the pistons and the resultant action of the motor. A spark plug suitably mounted in the cylinder is disposed in position to fire the charge compressed in a compression and firing chamber.

It will be seen that all of the phases of a four-cycle motor are executed within a single cylinder in the traverse of the cylinder by each of four pistons, so that the energy or actuating medium is imparted to the secondary shaft during each and every complete rotation of each and every piston. And the shafts are utilized in their rotations by the pistons to cause rotation of the controllers, this rotation in turn rotating the balls within the cam and imparting to the controllers the peculiar and particular differential action which phases the pistons and produces the alternate accelerations and retardations of each thereof for the purposes and in the manner set forth.

It is obvious that many changes and variations an modifications may be made in departure from a particular description and showing of the accompanying drawings, in adapting the invention to varying conditions and requirements of use and service, without, however, departing from the true spirit of the invention.

The cam is of an ellipse like configuration set at the phase difference of 60° for transmitting continuously varying cyclic motion so that the shafts and their pistons will cooperate with each other at the predetermined relation and to rotate the shafts in ever advancing or forward direction but at different speeds and times relative to each other.

I claim:

1. A control system for controlling the rotative movements of a pair of coaxial shafts in a rotary internal combustion engine or pump including:

a pair of recessed controllers, each controller mounted on one of the coaxial shafts, two pairs of balls, each ball being receivable in one of the recesses defined by the confronting adjacent recesses of adjacent controllers, an eliptical cam having a closed eliptical surface, the controllers being extendable in a first plane through the cam with the balls being held captive between the controllers and closed elliptical surface of the cam lying in a second plane extending normal to the first plane for controlling the alternating shaft rotation whereby a first shaft rotates through a first arc of certain degrees while the second shaft rotates through a second arc of greater degrees than the first arc followed by the rotation of the second shaft through the first arc of certain degrees while the first shaft rotates through the second arc of greater degrees than the first arc.

2. In a cam system for achieving alternating movements of primary secondary shafts coaxial to each other and partially disposed one within the other comprising:

an apertured wall with the aperture defining an internal closed curved surface of elliptical configuration extending in a first plane, a pair of internested controllers each mounted on one of the shafts and being rotatable therewith, the controllers being alternately movable toward and away from each other, pairs of balls being receivable between the confronting opposite surfaces of the internested controllers, the controllers being extendable through the cam in a second plane normal to the first plane with the balls being held captive between the controllers and cam surface wherefore a first controller rotates through an arc of say 60° while the second one will rotate through an arc of say 120° and an alternation takes place so that the first one next moves through an arc of 120° and the second one moves through an arc of 60°.

3. In a rotary engine or pump including a power section and a driving section wherein the power section includes a secondary shaft co-axial with and disposed within a primary quill-like shaft and the shafts are inseriatim rotated as to each other and each shaft mounts a pair of oppositely-disposed co-axial pistons and the two pairs of pistons rotate axially in a single direction about the common fixed axis and accelerate and decelerate as to each other within a common single cylinder and each piston pair defines a pair of working chambers formed in each instance by a surface of a piston and the confronting surface of the next-adjacent piston and the co-axial shafts exit from the cylinder for interconnection with the driving section and a working fluid is alternately introduced into and withdrawn from each working chamber for acting upon the movable piston and producing a mechanical force output from the cylinder and the pistons are in seriatim alternately and relatively driven at increased and decreased speeds to alternately approach and recede from each other and to expand and contract the respective working chambers and the continuous rotative movements of the pistons are controlled by the coacting elements of the cooperant driving section, the improvement in a control mechanism for the driving section for controlling the driving of the coaxial shafts and supported pistons alternately and intermittently in harmonic phase comprising;

a primary controller splined to the primary shaft, a secondary controller splined to the secondary shaft, the primary and secondary controllers being interdigitated as to each other and each being provided with a recess at each of their confronting faces, a ball means disposed in each way defined by the confronting recesses of adjacent faces of adjacent controllers, a cam having an endless cam surface, the controllers being extendable in a first plane through the cam with the balls being held captive between the controllers and cam surface lying in a second plane extending normal to the first plane for controlling the alternating shaft rotation whereby a first shaft rotates through the first arc of certain degrees while the second shaft rotates through a second arc of greater degrees than the first arc followed by the rotation of the second shaft through a second arc of greater degrees than the first arc.

4. In a rotary engine or pump including a power section and a driving section wherein the power section includes a secondary shaft co-axial with and disposed within a primary quill-like shaft and the shafts are inseriatim rotated as to each other and each shaft mounts a pair of oppositely-disposed co-axial pistons and the two pairs of pistons rotate axially in a single direction about the common fixed axis and accelerate and decelerate as to each other within a common single cylinder and each piston pair defines a pair of working chambers formed in each instance by a surface of a piston and the confronting surface of the next-adjacent piston and the co-axial shafts exit from the cylinder for interconnection with the driving section and a working fluid is alterntely introduced into and withdrawn from each working chamber for acting upon the movable piston and producing a mechanical force output from the cylinder and the pistons are in seriatim alternately and relatively driven at increased and decreased speeds to alternately approach and recede from each other and to expand and contract the respective working chambers and the continuous rotative movements of the pistons are controlled by the coacting elements of the cooperant driving section, the improvement in a control mechanism for the driving section for controlling the driving of the coaxial shafts and supported pistons alterntely and intermittently in harmonic phase comprisong:

a primary controller splined to the primary shaft, a secondary controller splined to the secondary shaft, the primary and secondary controllers being interdigitated as to each other and each being provided with a recess at each of their confronting faces, a ball means disposed in each way defined by the confronting recesses of adjacent faces of adjacent controllers, a cam having an endless cam surface, the controllers being extendable in a first plane through the cam with the ball means being held captive between the controllers and cam surface lying in a second plane extending normal to the first plane for controlling the alternating shaft rotation whereby a first shaft rotates through a first arc of certain degrees while the second shaft rotates through a second arc of greater degrees than the first arc followed by the rotation of the second shaft through a second arc of greater degrees than the first arc by the reaction of the ball means against the cam surface responsively to the expansion and contraction of the working chambers and concomitant rotative movement of the pistons and shafts.

* * * * *